US011053755B2

(12) United States Patent
Tarique et al.

(10) Patent No.: US 11,053,755 B2
(45) Date of Patent: Jul. 6, 2021

(54) IRON ROUGHNECKS FOR NON-STOP CIRCULATION SYSTEM

(71) Applicant: SCHLUMBERGER TECHNOLOGY CORPORATION, Sugar Land, TX (US)

(72) Inventors: Zaurayze Tarique, Calgary (CA); Blaine Dow, Sugar Land, TX (US); Justin Cremer, Houston, TX (US)

(73) Assignee: Schlumberger Technology Corporation, Sugar Land, TX (US)

( * ) Notice: Subject to any disclaimer, the term of this patent is extended or adjusted under 35 U.S.C. 154(b) by 0 days.

(21) Appl. No.: 16/478,844

(22) PCT Filed: Jan. 18, 2018

(86) PCT No.: PCT/US2018/014123
§ 371 (c)(1),
(2) Date: Jul. 17, 2019

(87) PCT Pub. No.: WO2018/136571
PCT Pub. Date: Jul. 26, 2018

(65) Prior Publication Data

US 2020/0056433 A1 Feb. 20, 2020

Related U.S. Application Data

(60) Provisional application No. 62/447,725, filed on Jan. 18, 2017.

(51) Int. Cl.
*E21B 19/16* (2006.01)
*E21B 21/10* (2006.01)
(Continued)

(52) U.S. Cl.
CPC ..... *E21B 19/161* (2013.01); *E21B 21/106* (2013.01); *E21B 19/165* (2013.01);
(Continued)

(58) Field of Classification Search
CPC .... E21B 19/161; E21B 21/106; E21B 21/085; E21B 2200/06; E21B 19/065; E21B 19/168; E21B 21/21
See application file for complete search history.

(56) References Cited

U.S. PATENT DOCUMENTS 6,212,763 B1 4/2001 Newman
2003/0164071 A1 9/2003 Moe et al.
(Continued)

FOREIGN PATENT DOCUMENTS

WO 2005/019596 A1 3/2005
WO 2004/077187 A1 1/2009
WO 2009/093069 A2 7/2009

OTHER PUBLICATIONS

International Search Report and Written Opinion for the equivalent International patent application PCT/US2018/014123 dated May 10, 2018.

(Continued)

*Primary Examiner* — Brad Harcourt
(74) *Attorney, Agent, or Firm* — Jeffrey D. Frantz

(57) ABSTRACT

An iron roughneck for constant circulation of drilling mud during operation of a drill string, the iron roughneck comprising: a frame; a wrench unit supported by the frame, wherein the wrench unit is capable of gripping a drill string; a spinner unit supported by the frame, wherein the spinner unit is capable of engaging and spinning a drill pipe; and a circulation coupler supported by the frame, wherein the circulation coupler forms a chamber around the drill string.

16 Claims, 6 Drawing Sheets

(51) Int. Cl.
*E21B 21/12* (2006.01)
*E21B 21/08* (2006.01)

(52) U.S. Cl.
CPC ..... *E21B 19/168* (2013.01); *E21B 21/085* (2020.05); *E21B 21/12* (2013.01); *E21B 2200/06* (2020.05)

(56) References Cited

U.S. PATENT DOCUMENTS

| | | | | |
|---|---|---|---|---|
| 2009/0025930 | A1* | 1/2009 | Iblings | E21B 21/002 166/244.1 |
| 2009/0205838 | A1* | 8/2009 | Springett | E21B 21/01 166/380 |
| 2011/0308860 | A1* | 12/2011 | deBoer | E21B 19/16 175/57 |

OTHER PUBLICATIONS

International Preliminary Report on Patentability for the equivalent International patent application PCT/US2018/014123 dated Aug. 1, 2019.

* cited by examiner

IRON ROUGHNECKS FOR NON-STOP CIRCULATION SYSTEM

This application claims the benefit of and priority to a US Provisional Application having Ser. No. 62/447,725, filed 18 Jan. 2017, which is incorporated by reference herein.

BACKGROUND

To drill a wellbore, a drill string is operated by a derrick and associated pipe handling equipment. The drill string comprises stands of drill pipe and a bottom hole assembly (drill bit, drill collars, and drilling related tools). An iron roughneck is used to make-up and break-out the threaded joints between the stands of drill pipe. FIGS. 1A and 1B illustrate perspective and side views of a typical iron roughneck 80. An iron roughneck 80 usually has two main devices: a wrench unit 81 and a spinner unit 84. The wrench unit 81 grips the drill pipe suspended in the rotary table in the rig floor and prevents the drill pipe from rotating while a stand of drill is being made-up or broken-out. The wrench unit 81 may have an upper wrench 82 that applies the torque necessary for final make-up or initial break-out for the pipe connection. The wrench unit 81 may also have a lower wrench 83 that is a back-up to the upper wrench 82 and grips the pipe suspended in the rig floor. The spinner unit 84 of the iron roughneck 80 rotates a stand of drill pipe relative to the pipe in the grip of the wrench unit 81. The spinner unit 84 will either screw the pin end of the stand of drill pipe into the box end of the gripped pipe, or it will unscrew a stand of drill pipe from the drill string.

During downhole drilling operations, an earth-boring drill bit is typically mounted on the lower end of a drill string and is rotated by rotating the drill string at the surface or by actuation of downhole motors or turbines, or by both methods. When weight is applied to the drill string, the rotating drill bit engages the earthen formation and proceeds to form a borehole along a predetermined path toward a target zone. Because of the energy and friction involved in drilling a wellbore in the earth's formation, drilling fluids, commonly referred to as drilling mud, are used to lubricate and cool the drill bit as it cuts the rock formations below. Furthermore, in addition to cooling and lubricating the drill bit, drilling mud also performs the secondary and tertiary functions of removing the drill cuttings from the bottom of the wellbore and applying a hydrostatic column of pressure to the drilled wellbore.

Typically, drilling mud is delivered to the drill bit from the surface under high pressure through a central bore of the drill string. From there, nozzles on the drill bit direct the pressurized mud to the cutters on the drill bit where the pressurized mud cleans and cools the bit. As the fluid is delivered downhole through the central bore of the drill string, the fluid returns to the surface in an annulus formed between the outside of the drill string and the inner profile or wall of the drilled wellbore. Drilling mud returning to the surface through the annulus does so at lower pressures and velocities than it is delivered. Nonetheless, a hydrostatic column of drilling mud typically extends from the bottom of the hole up to a bell nipple of a diverter assembly on the drilling rig. Annular fluids exit the bell nipple where solids are removed, the mud is processed, and then prepared to be re-delivered to the subterranean wellbore through the drill string.

As wellbores are drilled several thousand feet below the surface, the hydrostatic column of drilling mud in the annulus serves to help prevent blowout of the wellbore, as well. Often, hydrocarbons and other fluids trapped in subterranean formations exist under significant pressures. Absent any flow control schemes, fluids from such ruptured formations may blow out of the wellbore and spew hydrocarbons and other undesirable fluids (e.g., H2S gas). Problems encountered during perforation include: (i) kick phenomena in the formation, which bring a reservoir of high-pressure gases or fluids up to the surface; (ii) absorption phenomena in the well during perforation, which yield to loss of drilling mud in the formation resulting in environmental and economic damage; (iii) control of the properties of the mud entering the well; (iv) control of the properties of the mud exiting the well; (v) ascent of gases which can lead to hazards; (vi) ability to load the drill pipes in safety; and (vii) control of all physical and fluid dynamical properties involved in the drilling.

For mud circulation drilling, several systems have been developed to allow control of the flow entering and exiting the well and to avoid kick and absorption phenomena. The flow of drilling mud entering the well may be determined by the pumping equipment, therefore the flow may be held constant. In standard conditions and barring any anomalies, the flow exiting the well must be equal to the flow entering the well for less than a measurement error. In many cases the exiting flow is not constant and is often not even comparable to the entering flow, despite accounting for measurement errors. This variation is due to phenomena occurring inside the well, which can sometimes compromise the outcome of the drilling operation. Several well-control systems employed in mud circulation drilling control entry and exit flows and pressures via choke valves and sensors to control and monitor the well's backpressure to predict and manage any possible hazards.

However, the standard systems do not provide control over the flows when the pumps are shut down during drill pipe loading/tripping. In this stage of drilling, there is a danger of kick phenomena because pressure is not maintained constant inside the hole, and the subsequent cycle of increases and decreases in pressure on the well walls induces hydraulic fracturing in undesired places. Furthermore, continuous circulation helps to prevent debris from falling towards the bottom of the well, but instead it keeps it moving upwards so as to prevent the drill string from getting stuck.

There is a need for a continuous circulation system that allows the drilling mud to be circulated at all times during the drilling process.

BRIEF DESCRIPTION OF THE DRAWINGS

A more complete understanding of the present embodiments may be acquired by referring to the following description taken in conjunction with the accompanying drawings, in which like reference numbers indicate like features.

DETAILED DESCRIPTION

Preferred embodiments are best understood by reference to FIGS. 1-6 below in view of the following general discussion. The present disclosure may be more easily understood in the context of a high level description of certain embodiments.

Figure 2:
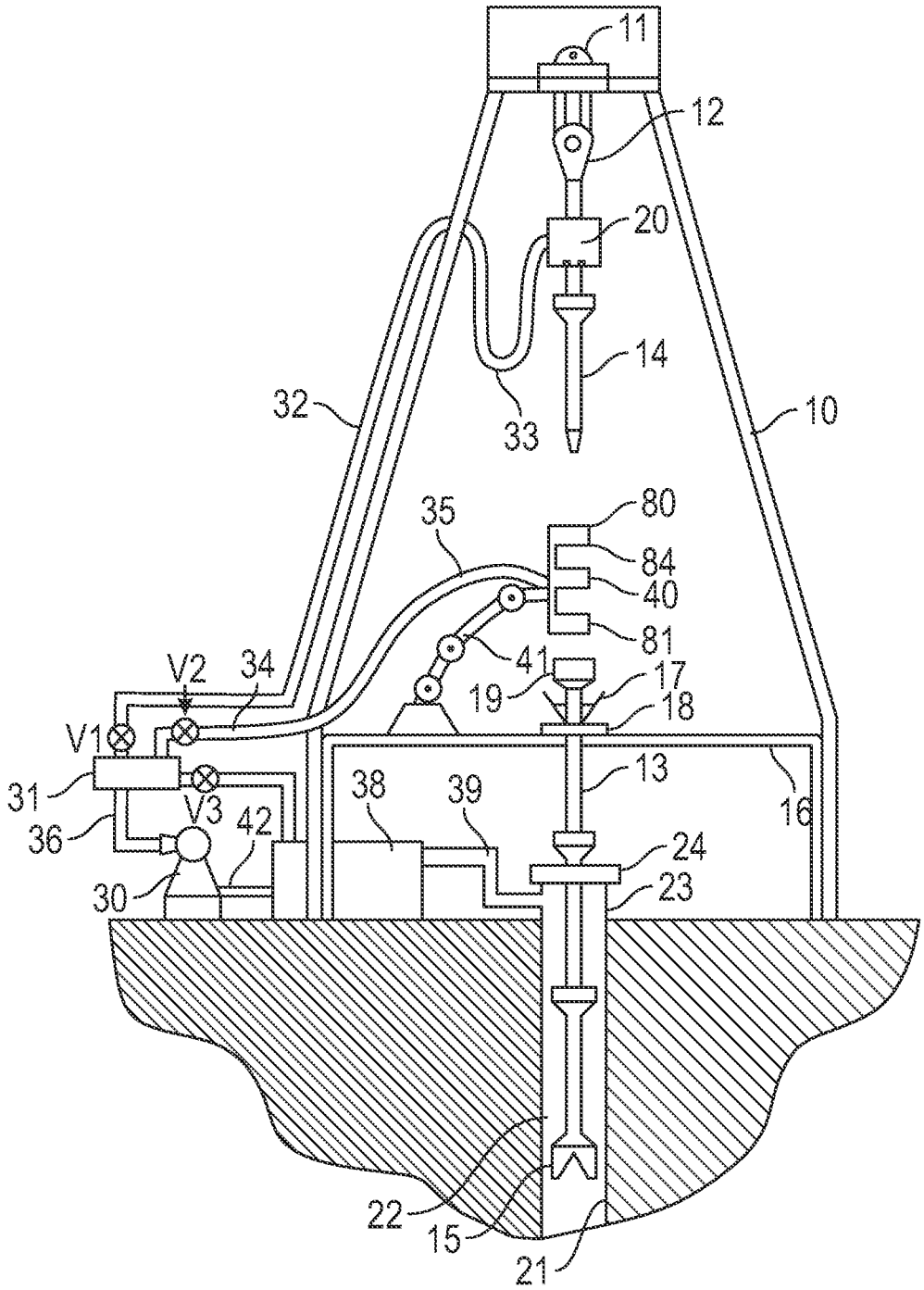
FIG. 2 shows a constant circulation system having an iron roughneck with an integrated circulation coupler.

FIG. 2 shows an embodiment of the invention. A drilling derrick 10 supports a crown block 11 and a travelling block 12 for making up drill pipe 14 sections of a drill string 13. A top drive 20 is suspended from the travelling block 12. A drill bit 15 is made up to the end of the drill string 13. The drill string 13 is suspended from the rig floor 16 via slips 17 in a rotary table 18 so that a stump 19 extends above the rig floor 16. An iron roughneck 80 is supported by arm 41 above the rig floor 16, wherein the iron roughneck 80 comprises a spinner unit 84, a circulation coupler 40, and a wrench unit 81. The drill string 13 extends into the wellbore 21 so that there is an annulus 22 between the exterior of the drill sting 13 and the walls of the wellbore 21. A surface casing 23 extends from the top of the wellbore 21 and a rotating control device 24 is attached to the top of the surface casing 23. A blow out preventer (BOP), not shown, may be incorporated into the surface casing.

Drilling mud is circulated via a mud pump 30. The drilling mud is supplied to the drill string 13 via a diverter manifold 31. A pressure line 36 extends from the mud pump 30 to the diverter manifold 31. A line extends from the diverter manifold to the stand pipe 32, wherein the stand pipe 32 is connected to the top drive 20 via a rotary hose 33. Another line extends from the diverter manifold 31 floor pipe 34, wherein the floor pipe 34 is connected to the circulation coupler 40 of the iron roughneck 80 via a rotary hose 35. A discharge line extends from the diverter manifold 31 to a retention tank or sump 38. Drilling mud being circulated up the annulus 22 is returned to the retention tank 38 via return line 39 connected to the surface casing 23 below the rotating control device 24. Drilling mud from the retention tank 38 is supplied to the mud pump 30 via a supply line 42.

During drilling, the mud pump 30 injects drilling mud through the top drive 20 into the drill string 13. The diverter manifold is configured to only supply drilling mud to the stand pipe 32. When a stand of drill pipe 14 is to be added to the drill string 13, the drill string 13 is raised and the slips 17 are set. The iron roughneck 80 grips the stump 19 of the drill string 13 with the wrench unit 81 and engages the new stand of drill pipe 14 with the spinner unit 84, while the circulation coupler 40 engages a circulation sub in the drill string having a radial port. The operator may then increase a supply of drilling mud to the circulation coupler 40 while a supply of drilling mud to the top drive 20 is decreased, so as to maintain a constant circulation while the supply is shifted from the top drive 20 to the circulation coupler 40. When drilling mud is no longer being supplied to the top drive 20, the top drive 20 is disconnected from the stump 19 of the drilling string 13 and another stand of drill pipe 14 is made up to the top drive 20. While the top drive 20 is disconnected from the drill string 13, the rotary table 18 may continue to turn the drill string 13 while drilling mud is supplied to the drill string 13 via the circulation coupler 40. The new stand of drill pipe 14 may then be made up to the stump 19 of the drill string 13. The operator may then decrease a supply of drilling mud to the circulation coupler 40 while a supply of drilling mud to the top drive 20 is increased, so as to maintain a constant circulation while the supply is shifted from the circulation coupler 40 to the top drive 20. Both the top drive 20 and the rotary table 18 may rotate the drill string 13 as circulation is shifted from the circulation coupler 40 to the top drive 20.

Figure 3:
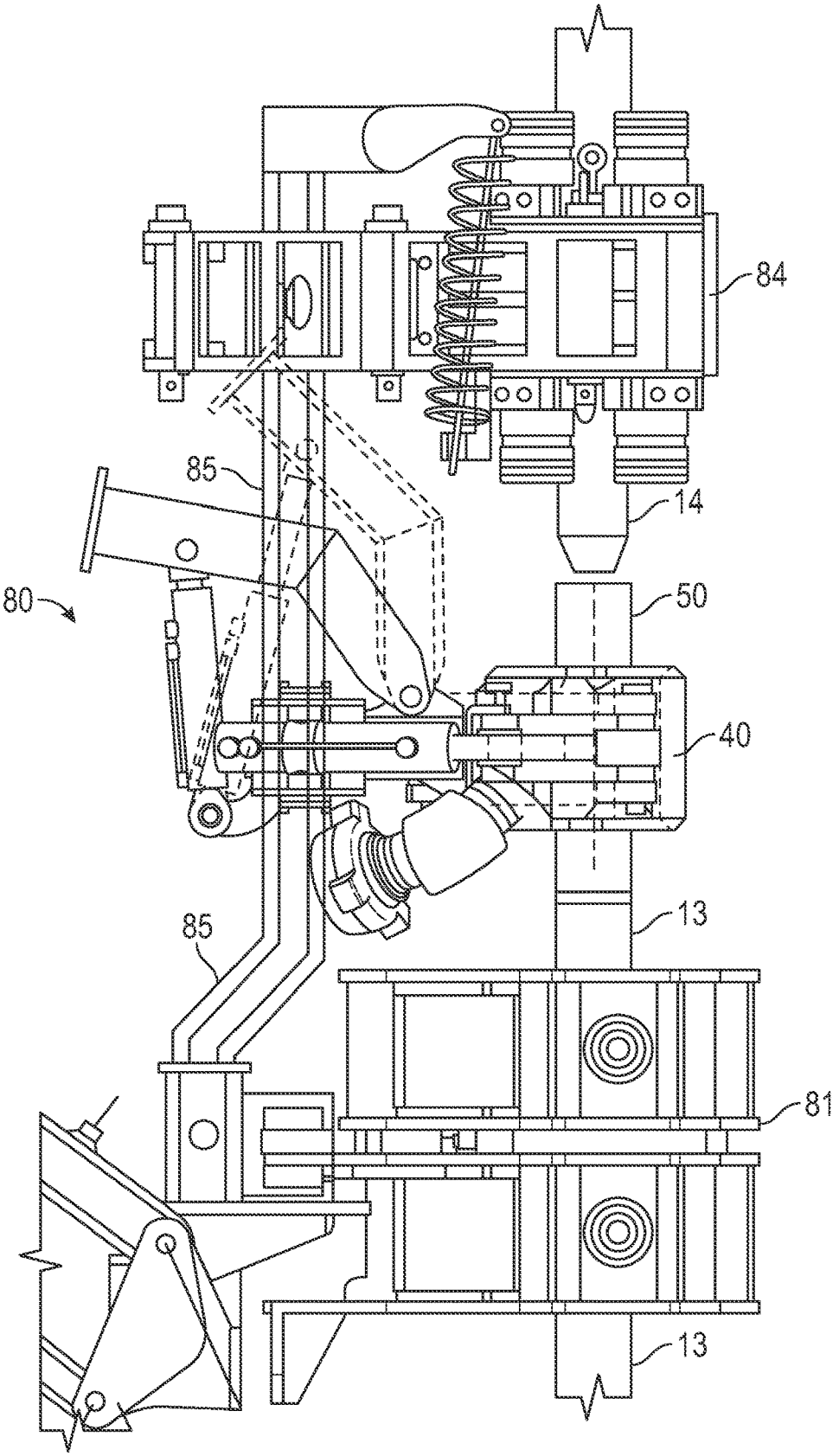
FIG. 3 shows a side view of an iron roughneck with an integrated circulation coupler.

FIG. 3 illustrates an iron roughneck 80 of the present invention having a spinner unit 84, a circulation coupler 40, and a wrench unit 81, all supported on a frame 85. A drill sting 13 is gripped by the wrench unit 81, wherein the drill string 13 has a constant circulation sub 50 made-up therein. The circulation coupler 40 is fastened around the constant circulation sub 50. A new stand of drill pipe 14 is positioned within the spinner unit 84 for being made-up to the constant circulation sub 50 portion of the drill string 13.

Figure 4:
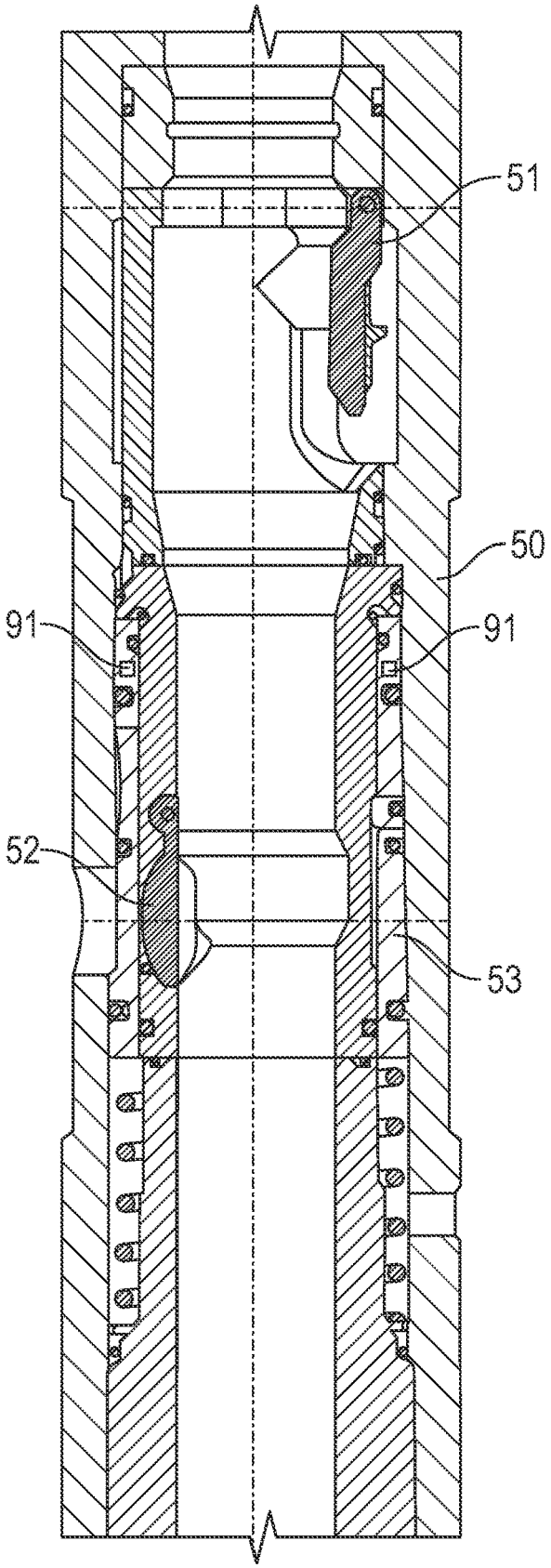
FIG. 4 illustrates a cross-sectional side view of a constant circulation sub for being made-up with drill pipe of a drill string.

FIG. 4 provides a cross-sectional side view of a constant circulation sub 50. The sub has an axial valve 51 and a radial valve 52. The valves are meant to be incorporated in the drilling string. Their external measures are similar to drilling pipes and they do not preclude the passage of special equipment inside them (i.e. OD 7"-ID 2 13/16"). They are formed by two valves, an axial 51 and a radial 52, both retractable, which allow the passage of fluids in both directions and allow rod replacement to happen without interruptions of the mud flow. The axial valve set 51 is composed of a jacket housing a swing pattern valve closing in the axial direction of the drilling mud. The axial swing check valve 51, capable of rotating on an orthogonal pivot, stays open by gravity when oriented vertically thanks to its weight, and thanks to centrifugal and hydrodynamic forces during perforation (even during horizontal perforation). The liner houses the valve 51 in such a way that it does not interfere with the passage of equipment inside the drilling string 13. The valve 51 is automatically closed when the flow is reversed, because it is rotated by hydrodynamic forces. In this situation the valve 51 is lifted from the jacket and seals perfectly the seat. Inside the body there is a second jacket with an internal swing check valve 52 and an external sliding valve 53. The operation of the sliding valve 53 is similar to that of a hydraulic piston. The sliding occurs thanks to difference in pressure between two chambers. In particular, the sliding compresses a spring which, once the pressure is balanced again, shuts the valve 53. This pressure difference between the two regions of the valve only happens when the circulation coupler 40 surrounds the constant circulation sub 50 and supplies relatively high pressure drilling mud to the outside of the sliding valve 53. In all other cases, the areas subjected to external pressure favor the closing of the valve 53, given that the area pushed by the spring is much bigger than the area subject to lateral pressure.

Figure 5A:
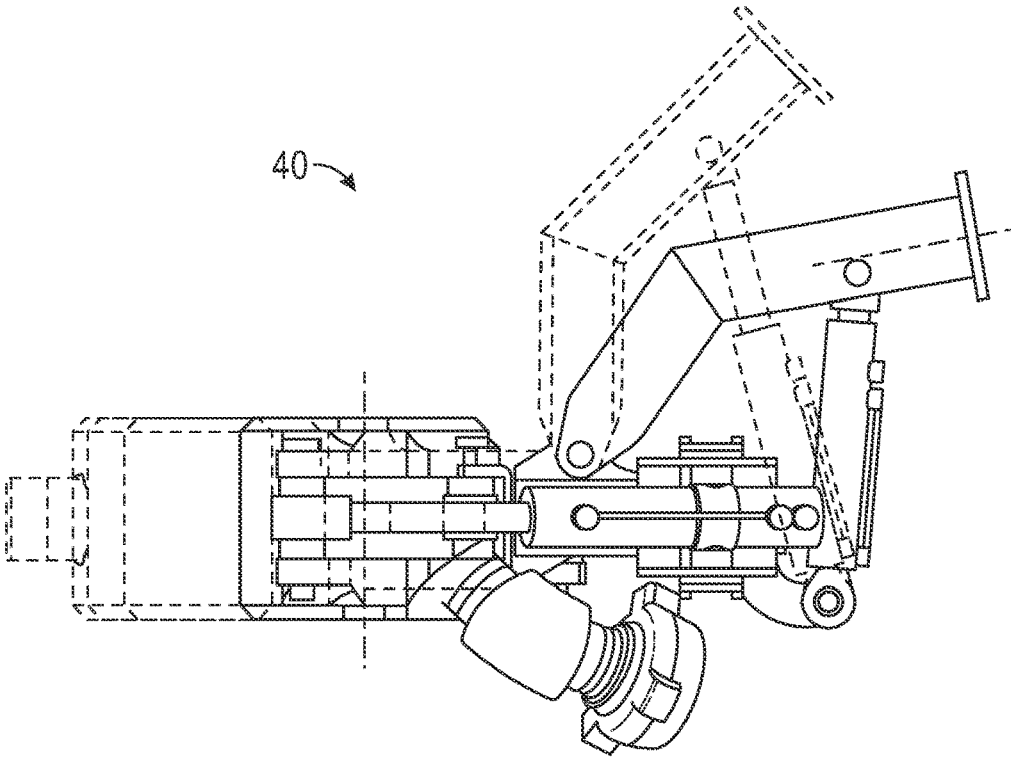
FIGS. 5A and 5B show side and top views of a circulation coupler having piston activated jaws.
Figure 5B:
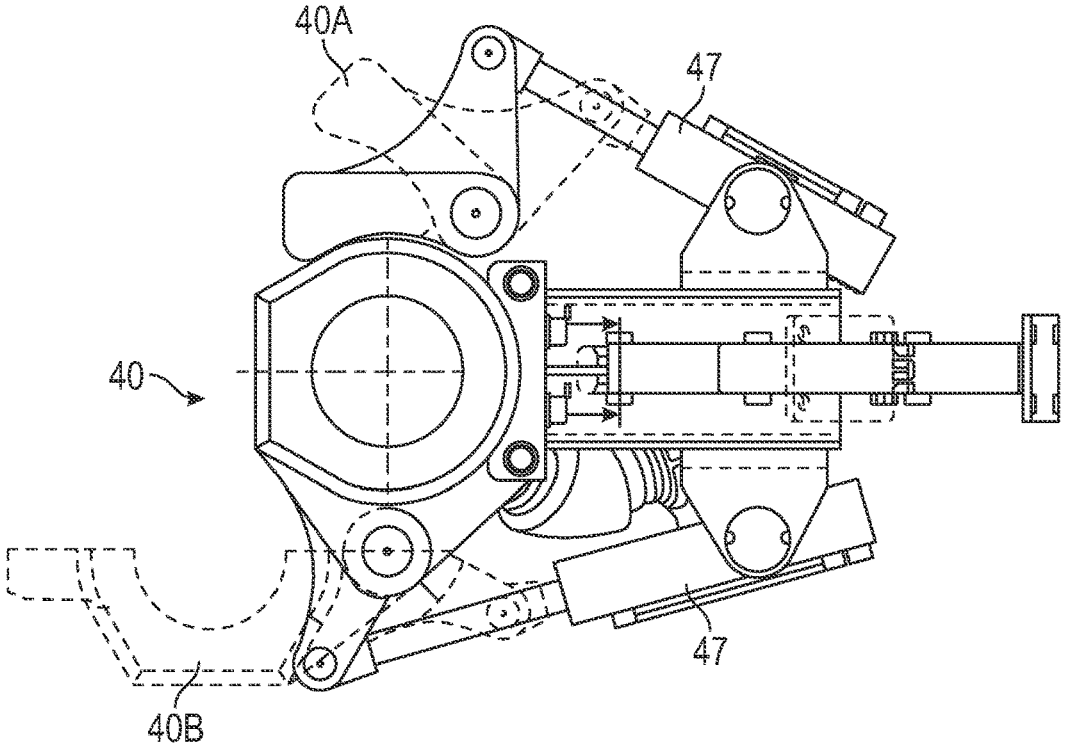

FIGS. 5A and 5B show side and top views, respectively, of a circulation coupler 40 of the present invention. In solid lines, the circulation coupler 40 is shown in a closed or gripping position and in dashed lines, it is shown in an open or un-gripping position. The circulation coupler 40 may have jaws 40*a* and 40*b* that open/close relative to a drill pipe 13. The jaws 40*a* and 40*b* of the circulation coupler 40 may be activated by hydraulic pistons 47 to move between positions.

Figure 6:
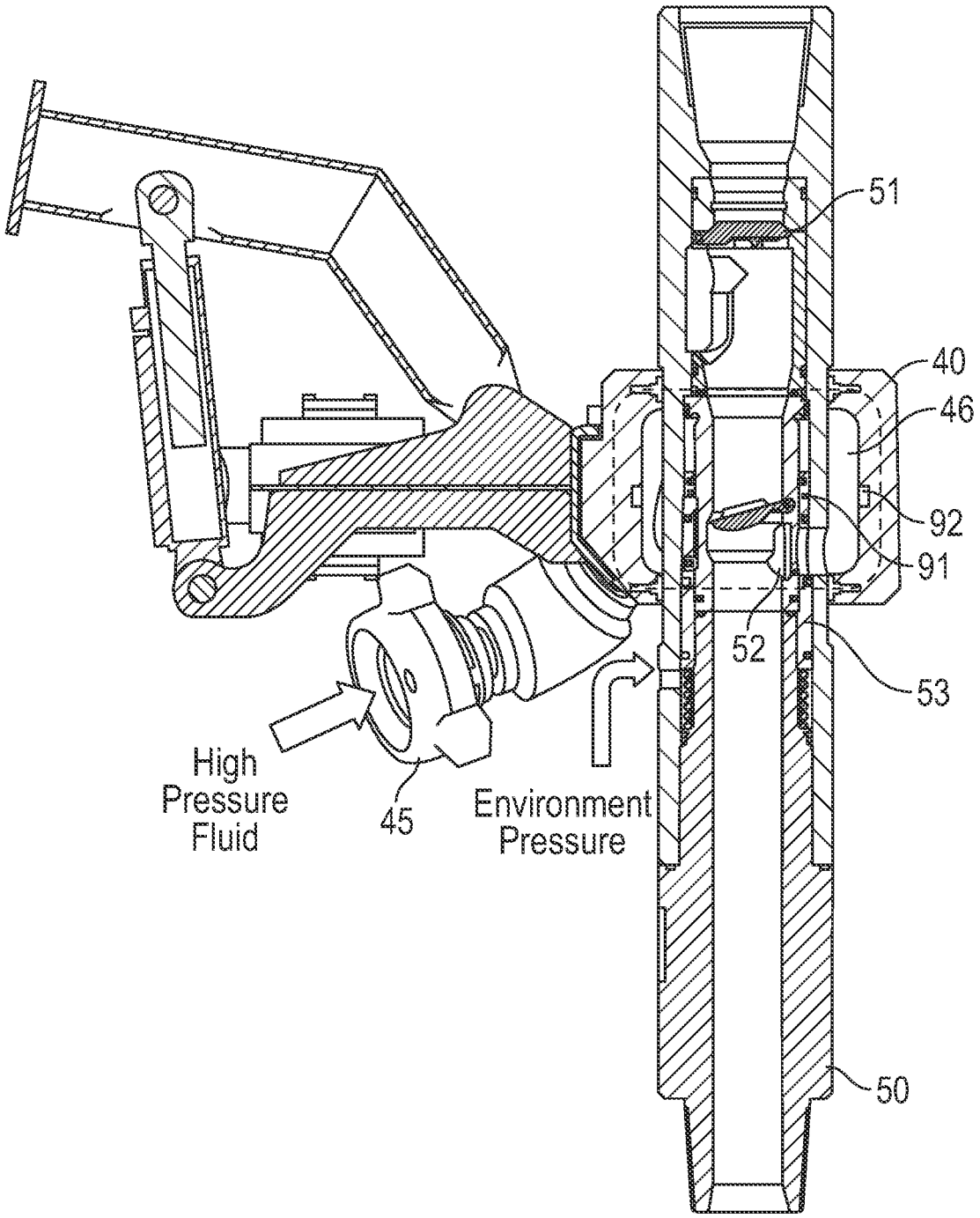
FIG. 6 illustrates a cross-sectional side view of a constant circulation sub engaged by a circulation coupler to form a chamber around a radial valve of the constant circulation sub.

FIG. 6 illustrates a side view of the circulation coupler 40 positioned around a constant circulation sub 50. The circulation coupler 40 may be tightened around the valves of the constant circulation sub 50 using two cylinders. Gaskets create a sealed chamber 46 able to keep the drilling mud and direct it inside the radial valve 52. The chamber 46, being radially oriented around the valve 52, ensures that drilling mud may be supplied to the radial valve 52 no matter the relative angular position of the constant circulation sub 50 relative to the circulation coupler 40. Furthermore, the chamber 46 prevents malfunctions and loss of pressure in case of unintentional rotation of the drill pipe (for instance during uncoupling of the drill pipes).

FIGS. 4 and 6 further illustrate a system that enables the operator to know whether the sliding valve 53 is open or closed. For obvious safety reasons and the need to maintain constant circulation, it is important for the operator to know whether the sliding sleeve valve 53 has closed before the circulation coupler 40 is opened or unclamped from the constant circulation sub 50. A magnet 91 may be placed in the sleeve 53 for detection be a magnetic sensor 92, wherein the magnetic sensor is positioned in the circulation coupler 40. The magnet 91 may be an annular magnet around the sleeve so that it is detectable regardless of angular position. Because the magnetic sensor 92 is in the circulation coupler 40, power and signal is easily supplied to the magnetic sensor 92 through the arm 41. Depending on the control system serving as the interface for the operator, an indicator may be provided to the operator as to whether the sliding sleeve valve 53 is open or closed. Any sensor known to persons of skill in the art may be used to provide an indication to the operator.

An alternative embodiment may use a pressure sensor in the chamber 46 to detect whether the pressure has been relieved, which may indicate that the sliding sleeve valve 53 and/or the radial valve 52 is open/closed. In alternative embodiments of the invention, sensors may also be placed to indicate whether the radial valve 53 and the axial valve 51 are open/closed.

In further embodiments of the invention, sensors in the constant circulation sub 50 may be detected by transducers in the circulation coupler 40 to detect whether the circulation coupler 40 of the iron roughneck 80 is vertically position relative to the constant circulation sub 50 for proper engagement. The arm 41 may be manipulated automatically or be the operator to properly position the iron roughneck 80.

Referring again to FIGS. 1A and 1B, during drilling the drill string 13 is suspended within the iron roughneck 80. The mud pump 30 injects drilling mud through the top drive 20 connected to the stump 19 of the drill string 13. In this case, valve V1 of a diverter manifold 31 may be open and valves V2 and V3 may be closed. When a stand of drill pipe 14 needs to be added to the drill string 13, the drill string 13 is raised and the slips 17 set. The drill string 13 may continue to be rotated via the rotary table 18 or the top drive 20. The circulation coupler 40 is positioned on the drill string 13 so that it is around the constant circulation sub 50 made up to the topmost stand of drill pipe 14 in the drill string 13. The controller may then begin to close valve V1 and apply pressure to the chamber 46 inside the circulation coupler 40 by opening valve V2. The increased pressure of the drilling mud inside the chamber 46 opens the sliding valve 53 in the constant circulation sub 50 (see FIG. 3) so that drilling mud begins to flow into the drill string through sliding valve 53 and radial valve 52. As valve V1 is fully closed and valve V2 is fully open, the axial valve 51 of the constant circulation sub 50 closes so that the top drive 20 may be disconnected from the stump 19 of the drill string. The drill string may continue to be rotated via the rotary table 18.

A new stand of drill pipe 14 may then be made up to the top drive 20. While the drill string is being rotated via the rotary table 18 and drilling mud is being circulated via the circulation coupler 40, the new stand of drill pipe 14 may be made up to the stump 19 of the drill string 13. In particular, the stump 19 of the drill string 13 may be gripped by the wrench unit 81 of the iron roughneck 80 while the spinner unit 84 engages the new stand of drill pipe 14. The spinner unit 84 rotates the drill pipe 14 to thread its pin thread into a box thread of the constant circulation sub 50. Once the new stand of drill pipe 14 is connected to and become part of the drill string 13, the drill string 13 may continue to be rotated via the rotary table 18 or the top drive 20. The drill string 13 may be lifted by the top drive 20 and the slips 17 released. Drilling mud may continue to be circulated through the drill string 13 by opening valve V1 to supply drilling mud to the top drive 20, while V2 is partially closed to reduce fluid flow to the circulation coupler 40. As drilling mud begins to flow down through the internal bore of the constant circulation sub 50, the axial valve 51 will open and the radial valve 52 will close. Valve V3 is opened to allow the drilling mud in the circulation coupler 40, rotary hose 35 and floor pipe 34 to drain back into the retention tank 38. As the pressure is relieved from the chamber 46 in the circulation coupler 40, an indication may be given to the operator that the sliding sleeve 53 of the constant circulation sub 50 is closed and/or that the pressure in the chamber 46 has been relieved, so that it is safe to open or unclamp the circulation coupler 40 from the constant circulation sub 50. The drill string 13 may continue to be rotated and lowered to continue drilling the well bore 21. After the drill string has drilled the wellbore the length of a drill pipe, the process is repeated.

When drill string 13 is tripped out of the well bore 21, a similar process is followed, in reverse order, to allow constant circulation of drilling mud and constant rotation of the drill string 13.

Figure 1A:
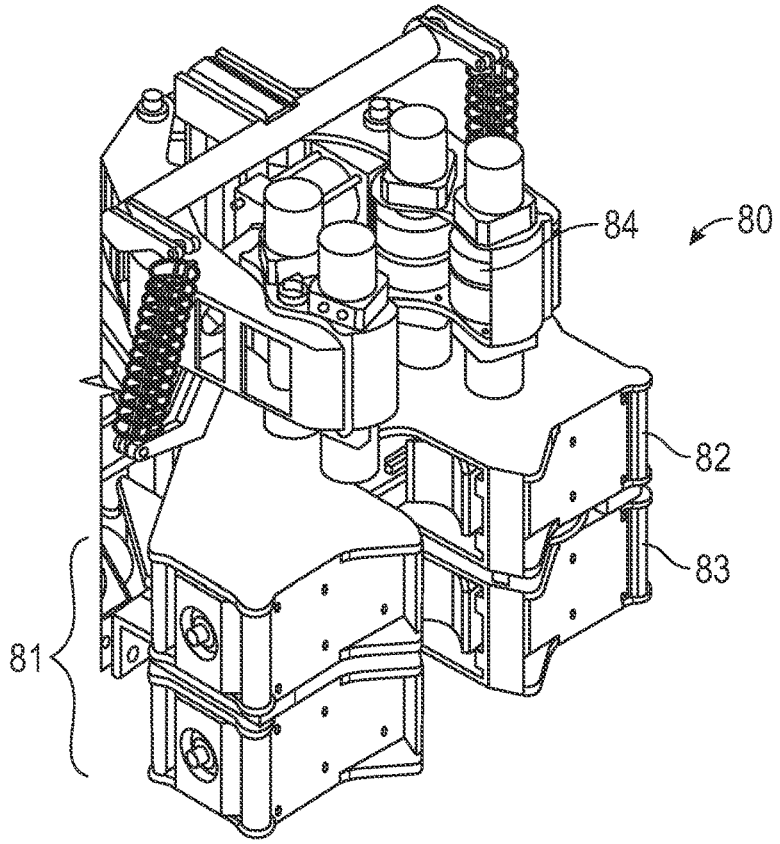
FIG. 1A (Prior Art)
FIGS. 1A and 1B illustrate perspective and side views of a prior art iron roughneck for engaging drill string to make-up and break-out the threaded joints between the stands of drill pipe.
Figure 1B:
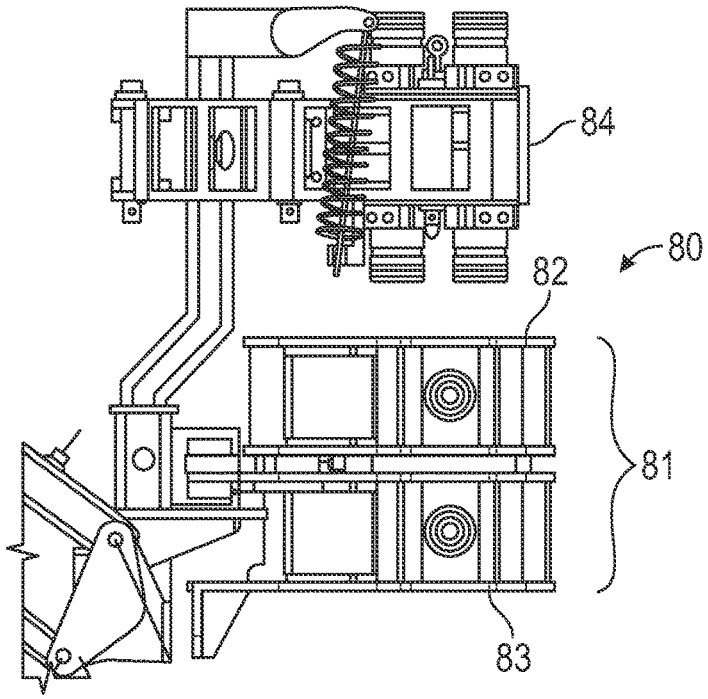
FIG. 1B (Prior Art)

In the embodiment of the invention shown in FIGS. 1A and 1B, the circulation coupler 40 is supported by an arm 41. However, in alternative embodiments, the circulation coupler may be mounted on a blow-out preventer (BOP) stack in a modular fashion. Alternatively, the circulation coupler 40 may be integral with a blow-out preventer (BOP) stack. In still further embodiments, the circulation coupler 40 may be mounted in a marine riser above a diverter or rotating control device. In still further embodiments, the circulation coupler 40 may be mounted anywhere in a drilling system so as to enable constant rotation of the drill string and constant circulation of drilling mud through the drill string.

Although the disclosed embodiments are described in detail in the present disclosure, it should be understood that various changes, substitutions and alterations can be made to the embodiments without departing from their spirit and scope.

What is claimed is:

1. An apparatus comprising:

a frame;

a wrench unit supported by the frame, wherein the wrench unit is capable of gripping a drill string;

a spinner unit supported by the frame, wherein the spinner unit is capable of engaging and spinning a drill pipe; and a circulation coupler supported by the frame and movable to an open position or a closed position, wherein the circulation coupler, when positioned around a drill string, having a wall with one or more valves provided therein, and located in the closed position, forms a sealed chamber radially oriented around the one or more valves of the drill string, wherein the circulation coupler further comprises a sensor for detecting whether a first valve in a drill string is located in an open position or a closed position, and wherein the first valve, detectable by the sensor, is an external sliding valve, comprising a spring, provided in the wall of the drill string.

2. The apparatus according to claim 1, wherein the wrench unit comprises an upper wrench and a lower wrench configured for gripping a drill string.

3. The apparatus according to claim 1, wherein the sensor is a magnetic sensor.

4. The apparatus according to claim 1, wherein the sensor is a pressure sensor.

5. The apparatus according to claim 1, wherein the circulation coupler comprises jaws operable by pistons to move to the circulation coupler to the open position or the close position relative to a drill pipe.

6. An apparatus according comprising:

a frame;

a wrench unit supported by the frame, wherein the wrench unit is capable of gripping a drill string;

a spinner unit supported by the frame, wherein the spinner unit is capable of engaging and spinning a drill pipe;

a circulation coupler supported by the frame and movable to an open position or a closed position, wherein the circulation coupler, when positioned around a drill string, having a wall with one or more valves provided therein, and located in the closed position, forms a sealed chamber radially oriented around the one or more valves of the drill string; and a sensor configured to detect a vertical position of the apparatus relative to a drill string.

7. The apparatus according to claim 6, wherein the wrench unit comprises an upper wrench and a lower wrench configured for gripping a drill string.

8. The apparatus according to claim 6, wherein the circulation coupler comprises jaws operable by pistons to move to the circulation coupler to the open position or the close position relative to a drill pipe.

9. A method for circulating drilling fluid during operation of a drill string, the method comprising:

gripping a first portion of the drill string with a wrench unit supported by a frame;

engaging a drill pipe with a spinner unit supported by the frame;

engaging a second portion of the drill string, having a radial port, with a circulation coupler supported by the frame such that a chamber is provided around the radial port; and increasing a supply of drilling fluid to circulation coupler and decreasing a supply of drilling fluid to a top end of the drill string such that circulation of drilling fluid to the drill string is maintained as the supply of drilling fluid shifts from the top end of the drill string to the circulation coupler, wherein the circulation coupler is positioned between the wrench unit and the spinner unit along a length of the frame.

10. The method according to claim 9, wherein the circulation of the drilling fluid to the drill string is maintained as constant and continuous circulation of drilling fluid to the drill string.

11. The method according to claim 9, further comprising:

providing at least one valve adjacent to the radial port of the drill string, wherein the chamber is radially oriented around the at least one valve and directs drilling fluid inside the at least one valve adjacent to the radial port of the drill string.

12. The method according to claim 11, further comprising:

supplying high pressure drilling fluid to an outside of the at least one valve via the chamber such that the at least one valve moves to an open position.

13. The method according to claim 11, further comprising:

detecting, via a sensor, whether the at least one valve is located in an open position or a closed position.

14. The method according to claim 13, wherein the sensor is provided in the circulation coupler or in the chamber provided around the radial port.

15. The method according to claim 9, further comprising:

disconnecting a top drive from the drill string when the supply of drilling fluid to the drill string has shifted to the circulation coupler;

connecting a stand of drill pipe to the disconnected top drive; and adding the stand of drill pipe to the drill string.

16. The method according to claim 15, further comprising:

shifting the circulation of the drilling fluid from the circulation coupler to the top end of the drill string after addition of the stand of drill pipe to the drill string.

* * * * *